US008823289B2

(12) United States Patent
Linz et al.

(10) Patent No.: US 8,823,289 B2
(45) Date of Patent: Sep. 2, 2014

(54) COLOR COORDINATION OF ELECTRONIC LIGHT SOURCES WITH DIMMING AND TEMPERATURE RESPONSIVENESS

(75) Inventors: Alfredo R. Linz, Austin, TX (US); Michael A. Kost, Cedar Park, TX (US); Sahil Singh, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 172 days.

(21) Appl. No.: 13/430,601

(22) Filed: Mar. 26, 2012

(65) Prior Publication Data

US 2012/0242242 A1 Sep. 27, 2012

Related U.S. Application Data

(60) Provisional application No. 61/467,258, filed on Mar. 24, 2011, provisional application No. 61/532,980, filed on Sep. 9, 2011.

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |

(52) U.S. Cl.
USPC ..... 315/309; 315/294; 315/297; 315/308

(58) Field of Classification Search
None
See application file for complete search history.

(56) References Cited

U.S. PATENT DOCUMENTS

| | | | |
|---|---|---|---|
| 4,409,476 | A | 10/1983 | Lofgren et al. |
| 6,016,038 | A | 1/2000 | Mueller et al. |
| 6,150,774 | A | 11/2000 | Mueller et al. |
| 6,211,626 | B1 | 4/2001 | Lys et al. |

(Continued)

FOREIGN PATENT DOCUMENTS

| | | |
|---|---|---|
| EP | 1528785 | 4/2005 |
| EP | 1842399 | 10/2007 |

(Continued)

OTHER PUBLICATIONS

Dyble, et al, Impact of Dimming White LEDS: Chromaticity Shifts in High-Power White LED Systems Due to Different Dimming Methods, International Society of OpticalEngineers, 2005, Fifth International Conference on Solid State Lighting, Proceedings of SPIE 5941: 291-299, Troy, NY, USA.

(Continued)

*Primary Examiner* — Anh Tran
(74) *Attorney, Agent, or Firm* — Terrile, Cannatti, Chambers & Holland, LLP; Kent B. Chambers

(57) ABSTRACT

A lighting system includes one or more methods and systems to control the color spectrum of a lamp in response to both temperature and dim levels. In at least one embodiment, the lighting system includes a controller to control a correlated color temperature (CCT) and intensity of the lamp by independently adjusting currents to electronic light sources based on a dim level of the lighting system and temperature of the lighting system. The controller controls a first current to a first set of LEDs and a second current to a second set of LEDs. The control of the first current by the controller is jointly dependent on a dim level and temperature in the lighting system. In at least one embodiment, the control of the second current is dependent on the dim level or the dim level and temperature.

41 Claims, 11 Drawing Sheets

(56) References Cited

U.S. PATENT DOCUMENTS

| | | | | |
|---|---|---|---|---|
| 6,369,525 | B1 | 4/2002 | Chang et al. | |
| 6,441,558 | B1 * | 8/2002 | Muthu et al. | 315/149 |
| 6,495,964 | B1 | 12/2002 | Muthu et al. | |
| 6,583,550 | B2 | 6/2003 | Iwasa et al. | |
| 6,636,003 | B2 | 10/2003 | Rahm et al. | |
| 6,688,753 | B2 | 2/2004 | Calon et al. | |
| 6,753,661 | B2 | 6/2004 | Muthu et al. | |
| 6,756,772 | B2 | 6/2004 | McGinnis | |
| 6,788,011 | B2 | 9/2004 | Mueller et al. | |
| 6,888,322 | B2 | 5/2005 | Dowling et al. | |
| 6,958,920 | B2 | 10/2005 | Mednik et al. | |
| 6,967,448 | B2 | 11/2005 | Morgan et al. | |
| 6,975,079 | B2 | 12/2005 | Lys et al. | |
| 7,064,498 | B2 | 6/2006 | Dowling et al. | |
| 7,079,791 | B2 | 7/2006 | Chang | |
| 7,088,059 | B2 | 8/2006 | McKinney et al. | |
| 7,116,294 | B2 | 10/2006 | Stopa | |
| 7,135,824 | B2 | 11/2006 | Lys et al. | |
| 7,213,940 | B1 | 5/2007 | VanDeVen et al. | |
| 7,246,919 | B2 | 7/2007 | Porchia et al. | |
| 7,255,457 | B2 | 8/2007 | Ducharme et al. | |
| 7,288,902 | B1 | 10/2007 | Melanson | |
| 7,375,476 | B2 | 5/2008 | Walker et al. | |
| 7,498,753 | B2 | 3/2009 | McAvoy | |
| 7,511,437 | B2 | 3/2009 | Lys et al. | |
| 2002/0145041 | A1 | 10/2002 | Muthu et al. | |
| 2004/0085030 | A1 | 5/2004 | Laflamme et al. | |
| 2004/0169477 | A1 | 9/2004 | Yanai | |
| 2004/0212321 | A1 | 10/2004 | Lys et al. | |
| 2005/0218838 | A1 | 10/2005 | Lys | |
| 2005/0231459 | A1 | 10/2005 | Furukawa | |
| 2005/0243022 | A1 | 11/2005 | Negru | |
| 2005/0253533 | A1 | 11/2005 | Lys et al. | |
| 2006/0023002 | A1 | 2/2006 | Hara et al. | |
| 2006/0125420 | A1 | 6/2006 | Boone et al. | |
| 2006/0226795 | A1 | 10/2006 | Walter et al. | |
| 2006/0232219 | A1 | 10/2006 | Xu | |
| 2007/0029946 | A1 | 2/2007 | Yu et al. | |
| 2007/0126656 | A1 | 6/2007 | Huang et al. | |
| 2007/0211013 | A1 | 9/2007 | Uehara et al. | |
| 2007/0262724 | A1 | 11/2007 | Mednik et al. | |
| 2008/0012502 | A1 | 1/2008 | Lys | |
| 2008/0018261 | A1 | 1/2008 | Kastner | |
| 2008/0054815 | A1 | 3/2008 | Kotikalapoodi et al. | |
| 2008/0116818 | A1 | 5/2008 | Shteynbert et al. | |
| 2008/0150433 | A1 | 6/2008 | Tsuchida et al. | |
| 2008/0224635 | A1 | 9/2008 | Hayes | |
| 2009/0184616 | A1 * | 7/2009 | Van De Ven et al. | 313/1 |
| 2009/0218960 | A1 | 9/2009 | Lyons et al. | |
| 2010/0244707 | A1 * | 9/2010 | Gaines et al. | 315/152 |

FOREIGN PATENT DOCUMENTS

| | | | |
|---|---|---|---|
| WO | 02/091805 | A2 | 11/2002 |
| WO | 02091805 | A2 | 11/2002 |
| WO | 2006/067521 | A1 | 6/2006 |
| WO | 2006067521 | | 6/2006 |
| WO | 2007/026170 | A2 | 3/2007 |
| WO | 2007026170 | A2 | 3/2007 |
| WO | 2008/072160 | A1 | 6/2008 |
| WO | 2011/061505 | A1 | 5/2011 |
| WO | 2011061505 | | 5/2011 |

OTHER PUBLICATIONS

Color Temperature, www.sizes.com/units/color_temperature.htm, printed Mar. 27, 2007.

Linear Technology, Triple Output LED Driver, Datasheet LT3496, Linear Technology Corporation, LT 0510 Rev F, 2007, Milpitas, CA, USA.

Dilouie, Craig, Introducing the LED Driver, Electrical Construction & Maintenance (EC&M), Sep. 1, 2004, ,pp. 28-32, Zing Communications, Inc., Calgary, Alberda, Canada.

Wikipedia, Light-Emitting Diode, http://en.wikipedia.org/wiki/Light-emitting_diode, printed Mar. 27, 2007.

Linear Technology, News Release, Triple Output LED Driver Drives Up to 24×500mA Leds & Offers 3,000:1 True Color PWM Dimming, Mar. 24, 2007, Milpitas, CA, USA.

Ohno, Yoshi, Spectral Design Considerations for White LED Color Rendering, Optical Engineering, vol. 44, Issue 11, Special Section on Solid State Lighting, Nov. 30, 2005, Gaithersburg, MD, USA.

Chromacity Shifts in High-Power White LED Systems Due toDifferent Dimming Methods, Solid-State Lighting, 2005, pp. 1-2, http://www.lrc.rpi.edu/programs/solidstate/completedprojects.asp?ID=76, printed May 3, 2007.

Color Temperature, Sizes, Inc., www.sizes.com/units/color_temperature.htm, Oct. 10, 2002, pp. 1-3, printed Mar. 27, 2007.

Linear Technology, News Release, Data Sheet LT3496,Triple Output LED Driver Drives Up to 24×500mA LEDs & Offers 3,000:1 True Color PWM Dimming, 2007, pp. 1-2, Milpitas, CA, USA.

C. Dilouie, Introducing the LED Driver, Electrical Construction & Maintenance (EC&M), Sep. 1, 2004, pp. 28-30, Zing Communications, Chicago, IL, USA.

Wikipedia, Light Emitting Diode, http://er.wikipedia.org/wiki/Light-emiting_diode, Mar. 2007, pp. 1-16, printed Mar. 27, 2007.

Y. Ohno, Spectral Design Considerations for White LED Color Rendering, Final Manuscript, Optical Engineering, Nov. 30, 005, pp. 1-20, vol. 44, 111302, Special Section on Solid State Lighting, National Institute of Standards and Technology, Gaithersburg, MD, USA.

* cited by examiner

| | | DIM_LEVEL | | | | | | | | | |
|---|---|---|---|---|---|---|---|---|---|---|---|
| | | 0.1 | 0.2 | 0.3 | 0.4 | 0.5 | 0.6 | 0.7 | 0.8 | 0.9 | 1 |
| | | | | | | | | | | | |
| TEMP-(AMBIENT)-°C | | $I_{LED_BIA}$-(A) | | | | | | | | | |
| 5.00 | | 0.033 | 0.069 | 0.104 | 0.136 | 0.165 | 0.188 | 0.204 | 0.214 | 0.217 | 0.212 |
| 15.00 | | 0.029 | 0.062 | 0.095 | 0.128 | 0.157 | 0.182 | 0.201 | 0.214 | 0.219 | 0.215 |
| 25.00 | | 0.027 | 0.058 | 0.091 | 0.124 | 0.155 | 0.183 | 0.204 | 0.219 | 0.226 | 0.222 |
| 45.00 | | 0.028 | 0.061 | 0.097 | 0.134 | 0.169 | 0.201 | 0.228 | 0.247 | 0.256 | 0.254 |
| 65.00 | | 0.034 | 0.073 | 0.116 | 0.160 | 0.202 | 0.240 | 0.272 | 0.295 | 0.307 | 0.305 |
| 85.00 | | 0.043 | 0.093 | 0.146 | 0.199 | 0.251 | 0.297 | 0.335 | 0.363 | 0.379 | 0.378 |

*FIG. 9*

| DIM_LEVEL | $I_{LED_avg}$ (A) |
|---|---|
| 0.1 | 0.050 |
| 0.2 | 0.110 |
| 0.3 | 0.178 |
| 0.4 | 0.250 |
| 0.5 | 0.321 |
| 0.6 | 0.386 |
| 0.7 | 0.441 |
| 0.8 | 0.481 |
| 0.9 | 0.502 |
| 1 | 0.500 |

FIG. 11

COLOR COORDINATION OF ELECTRONIC LIGHT SOURCES WITH DIMMING AND TEMPERATURE RESPONSIVENESS

CROSS-REFERENCE TO RELATED APPLICATION

This application claims the benefit under 35 U.S.C. §119(e) and 37 C.F.R. §1.78 of U.S. Provisional Patent Application No. 61/467,258, filed on Mar. 24, 2011 and U.S. Provisional Patent Application No. 61/532,980, filed on Sep. 9, 2011. U.S. Provisional Patent Application Nos. 61/467,258 and 61/532,980 are incorporated by reference in their entireties.

BACKGROUND OF THE INVENTION

1. Field of the Invention

The present invention relates in general to the field of electronics, and more specifically to a lighting system with color compensation for electronic light sources that responds to changing dim levels and changing temperature.

2. Description of the Related Art

Electronic light sources, such as light emitting diodes (LEDs), offer lower energy consumption and, in some instances, longer useful life relative to incandescent bulbs. In some instances, lamps with LEDs are designed to approximate the familiar color characteristics of incandescent bulbs. LEDs with different color spectra can be mixed within a lamp to approximate the color of an incandescent bulb. The color spectrum (e.g. the dominant wavelength) and brightness (i.e. luminosity) of an LED is a function of the junction temperature of the LED. Thus, as the junction temperature changes, the color of the LEDs can also change. The color spectrum of some LEDs varies with the junction temperatures of the LEDs more than others. For example, the brightness of blue-white LEDs varies less with temperature than that of red-amber LEDs. When the brightness from a mix of multi-colored LEDs changes, especially, when the brightness of one color changes more with respect to another color, the changing brightness causes the perceived color of the mix of the LEDs to change. Thus, to maintain a constant color of a group of LEDs, circuits have been developed to maintain a constant color as the junction temperature changes by adjusting the currents to counteract the changes induced by temperature.

The color of a light source, such as an LED, is often referenced as a "correlated color temperature" (CCT) or as a "color spectrum". The CCT of a light source is the temperature of an ideal black-body radiator that radiates light that is perceived as the same color as the light source. The color spectrum of a light source refers to the distribution of wavelengths of light emitted by the light source. Both CCT and color spectrum represent characteristics to classify the color of a light source.

FIG. 1 depicts a lighting system 100 that includes a lamp 101 that includes a lamp 101, and the lamp 101 includes two sets of LEDs referred to as LEDs 102 and LEDs 104. LEDs 102 have a red-amber color spectrum, and LEDs 104 have a blue-white color spectrum. The overall spectrum of the light from lamp 101 is a mixture of the color spectra from LEDs 102 and LEDs 104 and varies with the intensity (i.e. brightness) of the respective LEDs 102 and LEDs 104. The intensity of LEDs 102 and LEDs 104 is a function of the respective currents $i_{LED_A}$ and $i_{LED_B}$ to LEDs 102 and LEDs 104.

The lighting system 100 receives an AC supply voltage $V_{IN}$ from voltage supply 106. The supply voltage $V_{SUPPLY}$ is, for example, a nominally 60 Hz/110 V line voltage in the United States of America or a nominally 50 Hz/220 V line voltage in Europe and the People's Republic of China. The full-bridge diode rectifier 105 rectifies the supply voltage $V_{SUPPLY}$ for input to switching power converter 110. Controller 112 controls the switching power converter 110 to generate a light source current $i_{LS}$. Capacitors 120 and 122 each provide a standard filter across respective LEDs 102 and LEDs 104.

The current distributor 114 controls the current dividers 116 and 118 to respectively apportion the light source current $i_{LS}$ as $i_{LED_A}$ to LEDs 102 and $i_{LED_B}$ to LEDs 104. Since the proportional intensity of LEDs 102 and LEDs 104 and, thus, the color spectrum of lamp 101, is a function of the currents $i_{LED_A}$ and $i_{LED_B}$, by apportioning the current distributed to LEDs 102 and 104, the current distributor 114 causes the lamp 101 to generate a proportion of red-amber color to white-blue color to approximate the color spectra of an incandescent bulb.

The lamp 101 includes a negative temperature coefficient (NTC) resistor 117 to allow the current distributor 114 to sense the ambient temperature in proximity to LEDS 102 and LEDs 104. The resistance of NTC resistor 117 is indirectly proportional to changes in the ambient temperature. Changes in the value of TDATA associated with changes in the resistance of the NTC resistor 117 represent changes in the ambient temperature. Thus, by determining the value of TDATA, the current distributor 114 senses changes in the ambient temperature in proximity to LEDs 102 and LEDs 104.

The spectrum of red-amber LEDs 102 is more sensitive to junction temperature changes than the blue-white LEDs 104. As the ambient temperature in proximity to LEDs 102 and LEDs 104 changes, the junction temperatures also change. Sensing the ambient temperature in proximity to LEDs 102 and LEDs 104 represents an indirect mechanism for sensing changes in the junction temperatures of LEDs 102 and LEDs 104. Thus, sensing the ambient temperature approximates sensing the respective color spectrum of LEDS 102 and LEDs 104. Accordingly, as the ambient temperature changes, the current distributor 114 adjusts the currents $i_{LED_A}$ and $i_{LED_B}$ to maintain an approximately constant color spectrum of lamp 101.

However, the lighting system 100 relies on analog components to maintain the approximately constant color spectrum of lamp 101. Analog components are subject to variations due to temperature and fabrication tolerances and tend to limit the accuracy of the system. Furthermore, many lighting systems include dimmers to dim lamps. The dimmers set a particular dim level by, for example, modulating a phase angle of a supply voltage. It would be desirable to dynamically respond to changes in both the dim level and temperature in a multi-LED lighting system.

SUMMARY OF THE INVENTION

In one embodiment of the present invention, a lighting system includes a controller capable of controlling a first current to a first set of one or more electronic light sources and controlling a second current to a second set of one or more electronic light sources. Control of the first current by the controller is jointly dependent on a dim level and a temperature in the lighting system. Control of the second current by the controller is dependent on the dim level in the lighting system. The first set of one or more electronic light sources has a first correlated color temperature (CCT), and the second set of one or more electronic light sources has a second CCT.

In another embodiment of the present invention, a method includes controlling a first current to a first set of one or more electronic light sources and controlling a second current to a second set of one or more electronic light sources. Control of the first current by the controller is jointly dependent on a dim level and a temperature in the lighting system. Control of the second current by the controller is dependent on the dim level in the lighting system. The first set of one or more electronic light sources has a first correlated color temperature (CCT), and the second set of one or more electronic light sources has a second CCT.

In a further embodiment of the present invention, an apparatus includes means for controlling a first current to a first set of one or more electronic light sources and controlling a second current to a second set of one or more electronic light sources. Control of the first current by the controller is jointly dependent on a dim level and a temperature in the lighting system. Control of the second current by the controller is dependent on the dim level in the lighting system. The first set of one or more electronic light sources has a first correlated color temperature (CCT), and the second set of one or more electronic light sources has a second CCT.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

FIG. 9 depicts values of red-amber LEDs control current for an exemplary lamp.

FIG. 11 depicts values of blue-white LEDs control currents for an exemplary lamp.

DETAILED DESCRIPTION

Figure 1:
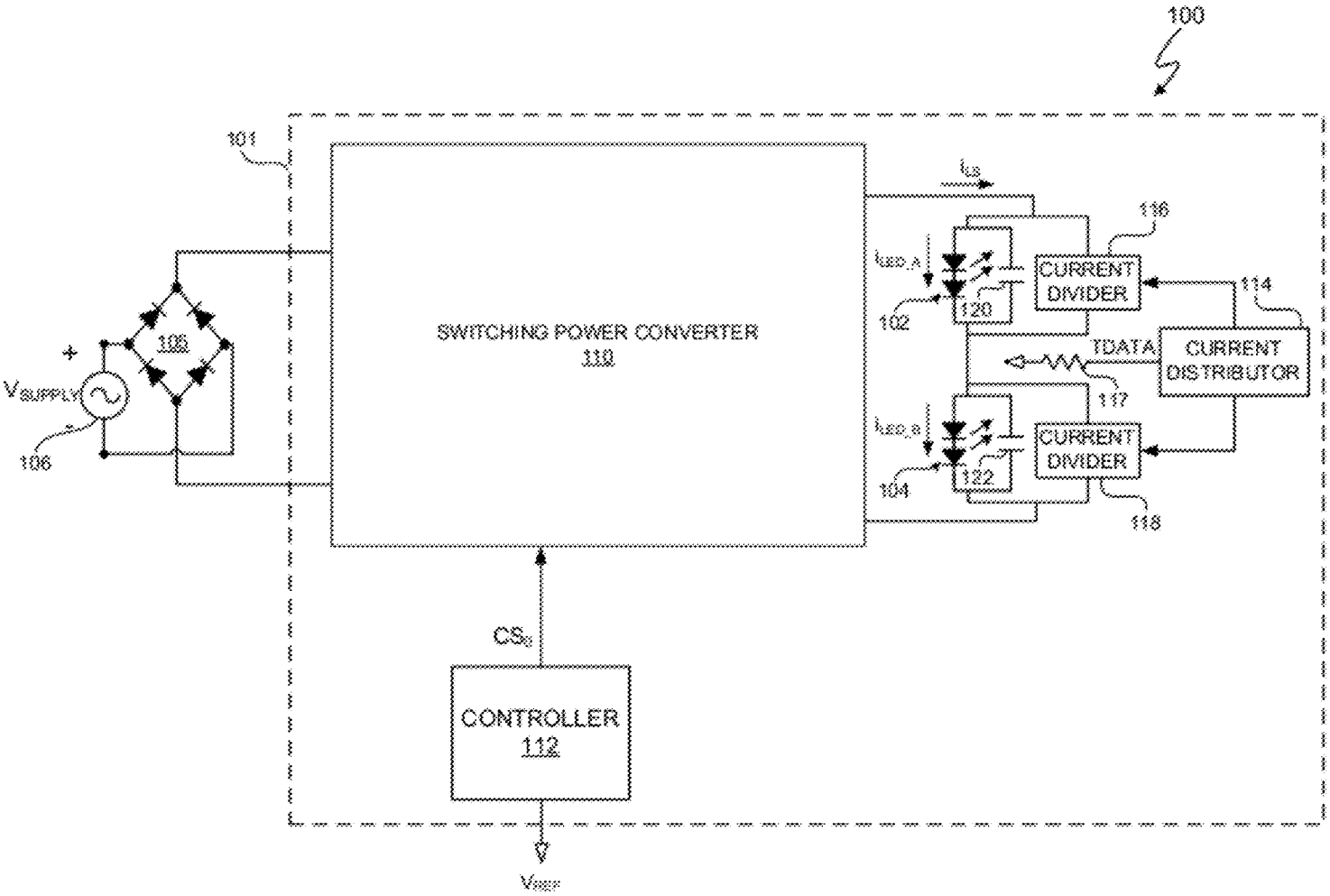
FIG. 1 (PRIOR ART)
FIG. 1 (labeled prior art) depicts a lighting system that includes two sets of LEDs for simulating an incandescent bulb.

A lighting system includes one or more methods and systems to control the color spectrum and, in at least one embodiment, luminosity, of a lamp in response to both temperature and dim levels. In at least one embodiment, the lighting system includes a controller to control a correlated color temperature (CCT) and intensity of the lamp by independently adjusting currents to electronic light sources based on a dim level of the lighting system and temperature of the lighting system. In at least one embodiment, the controller controls the CCT and intensity based on either information computed in a digital signal processor and/or stored in a memory. In at least one embodiment, the controller is capable of controlling a first current to a first set of one or more electronic light sources, such as one or more light emitting diodes (LEDs), and controlling a second current to a second set of one or more electronic light sources, such as one or more LEDs. The control of the first current by the controller is jointly dependent on a dim level and temperature in the lighting system. For example, in at least one embodiment, the current, the dim level, and the temperature are all jointly dependent, and the controller utilizes a function that directly or indirectly relates the current, the dim level, and the temperature to control the first current. In at least one embodiment, the control of the second current is dependent on the dim level or the dim level and temperature.

In at least one embodiment, the function is a polynomial approximation of a surface that represents the joint dependency of the first current (including a parameter related to the first current, such as current gain), the ambient temperature in the lamp, and a dim level set for the lighting system. In at least one embodiment, the CCT of the second set of electronic light sources is less dependent upon temperature, and the controller utilizes a function that directly or indirectly relates the current and the dim level in the lighting system. In at least one embodiment, the function to determine the second current is a polynomial approximation of a line curve that represents an approximation of the second current (including a parameter related to the second current, such as current gain) and the dim level set for the lighting system. In at least one embodiment, the coefficients of the polynomial functions are programmable and stored in a non-volatile memory. The coefficients can also be fixed. In at least one embodiment, the values of the first current (or a parameter representing the first current) are pre-calculated based on the joint dependency of the first current on the dim level and temperature. In at least one embodiment, the values of the second current are also pre-calculated based on the dependency of the second current on the dim level. The pre-calculated values of the first and second currents can be stored in a memory in a desired format, such as in a look-up-table. In at least one embodiment, some of the first current and/or second current values are pre-calculated and stored in a memory, and the controller determines other first current and/or second current values using the respective functions based on respectively jointly dependent dim level and temperature for the first current and dim level (or dim level and temperature) for the second current.

In at least one embodiment, the first set of one or more electronic light sources has a first CCT and the second set of one or more electronic light sources has a second CCT. The particular CCT's are a matter of design choice. In at least one embodiment, the first CCT is red-amber, and the second CCT is blue-white. Additionally, the number of sets of electronic light sources is a matter of design choice. Thus, the lighting system can include any number of sets of electronic light sources, such as LEDs, having any combination of CCT's.

Figure 2:
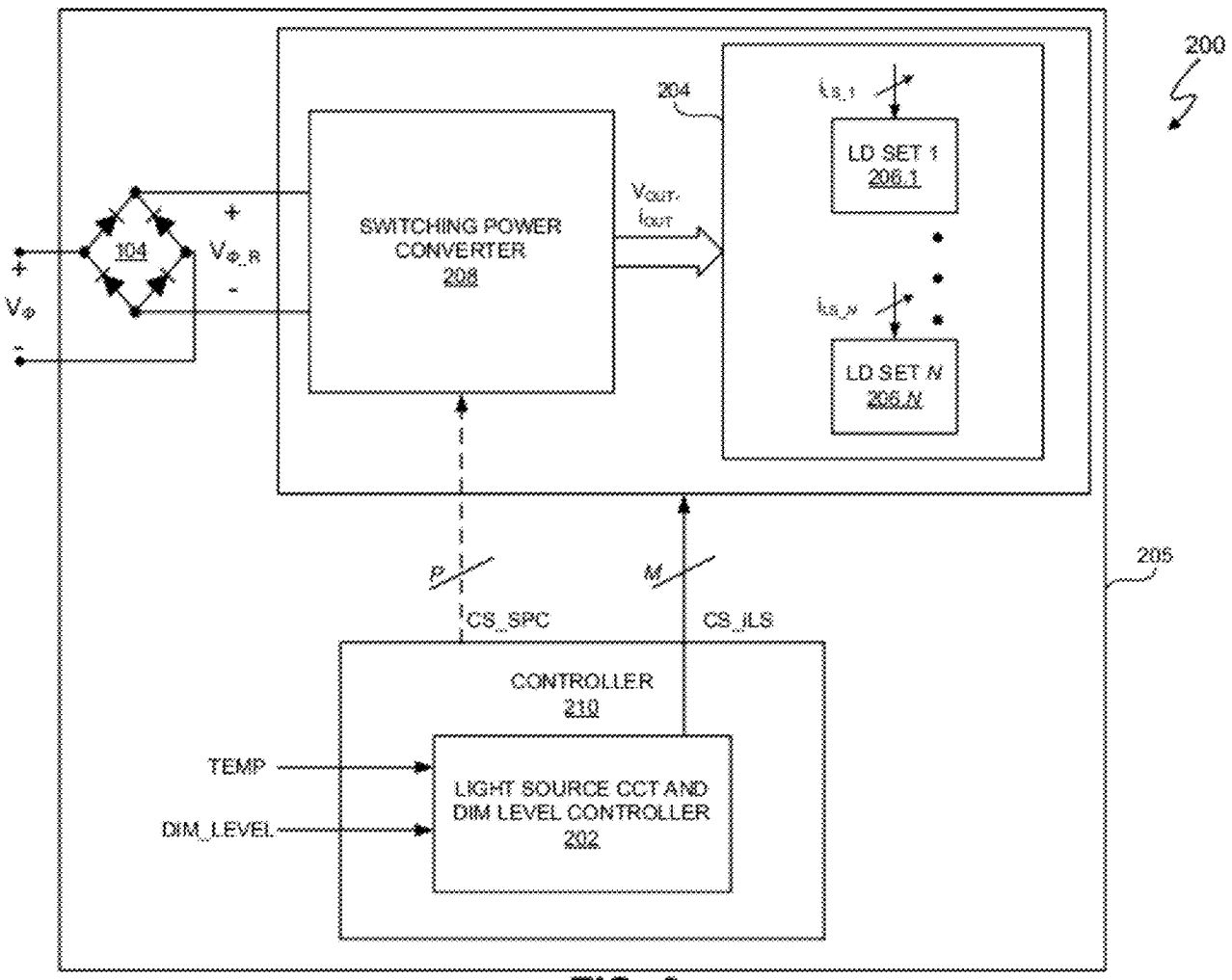
FIG. 2 depicts a lighting system 200 that includes a light source CCT and dim level controller to control the CCT and intensity of a lamp.

FIG. 2 depicts a lighting system 200 that includes a light source CCT and dim level controller 202 to control the CCT and intensity of light emitted by the light engine 204 of lamp 205 by independently adjusting currents $i_{LS_1}$ through $i_{LS_N}$ to respective light sources 206.1 through 206.N. "N" is an integer index number greater than or equal to two (2). Each of the N light sources 206.1 through 206.N includes one or more electronic light sources, such as one or more LEDs. The lighting system 200 receives a supply voltage $V_\phi$. The supply voltage $V_\phi$ is, for example, a line voltage such as $V_{SUPPLY}$ (FIG. 1) or a phase-cut voltage. In at least one embodiment, a dimmer, such as a triac-based dimmer, phase cuts a supply voltage, such as $V_{SUPPLY}$, to generate the phase cut voltage version of supply voltage $V_\phi$. Full-bridge diode rectifier 105 rectifies the supply voltage $V_\phi$ to generate a rectified supply voltage $V_{\phi_R}$. Switching power converter 208 converts the rectified supply voltage $V_{\Phi_R}$ into one or more approximately constant (DC) output voltages $V_{OUT}$ and one or more output currents $i_{OUT}$. In one embodiment, the light sources light sources 206.1 through 206.N are connected in series, and the switching power converter 208 supplies one output voltage $V_{OUT}$ and one output current $i_{OUT}$ to all the light sources 206.1 through 206.N. In at least one embodiment, the light sources 206.1 through 206.N are connected in parallel, and the switching power converter 208 generates a separate output voltage and separate output current $i_{OUT}$ for each of light sources 206.1 through 206.N. The particular type of switching power converter 208 is a matter of design choice. For example, the switching power converter 208 can be a boost, buck, boost-buck, flyback, or Cúk type switching power converter.

The CCT and dim level controller 202 also responds to the dim level represented by the signal DIM_LEVEL by lowering the intensity of light from light engine 204. To lower the intensity of the light, the CCT and dim level controller 202 reduces one or more of light source currents $i_{LS_1}$ through $i_{LS_N}$. The DIM_LEVEL signal can be any signal representing a dim level of the lighting system 200.

In at least one embodiment, the CCT and dim level controller 202 generates control signal(s) CS_ILS to control the currents $i_{LS_1}$ through $i_{LS_N}$. In at least one embodiment, current $i_{LS_1}$ is jointly dependent on at least the dim level of the lighting system 200 and the temperature of light engine 204. In at least one embodiment, the remaining light source currents $i_{LS_2}$-$i_{LS_N}$ are dependent on at least either temperature, dim level, or both temperature and dim level. The CCT and brightness of an individual LED is a function of the junction temperature of the LED. In at least one embodiment, for a constant light source current, the junction temperature of each of light sources 206.1 through 206.N directly varies with the ambient temperature in light engine 204. In at least one embodiment, the variable TEMP represents the ambient temperature in light engine 204.

The manner of generating the control signal(s) CS_ILS is a matter of design choice. As subsequently described in more detail, in at least one embodiment, CCT and dim level controller 202 determines each current $i_{LS_1}$ through $i_{LS_N}$ using one or more functions to compute the values of currents $i_{LS_1}$ through $i_{LS_N}$. In at least one embodiment, the function used by CCT and dim level controller 202 to determine the value of current $i_{LS_1}$ is dependent upon the characteristics of the respective light source 206.1 and the relationship between the temperature, the dim level, and a parameter related to the current $i_{LS_1}$. In at least one embodiment, the parameter related to the current $i_{LS_1}$ is a current gain parameter. In at least one embodiment, the functions used by CCT and dim level controller 202 to determine the values of current $i_{LS_2}$ and through $i_{LS_N}$ is dependent upon the characteristics of the respective light source 206.2 through 206.N and the relationship between a parameter related to the currents, such as a current gain, and the temperature or the temperature and the dim level.

As subsequently discussed in more detail, in at least one embodiment, the CCT and dim level controller 202 determines the light source current $i_{LS_1}$ by accessing a map of values that represent the dependency between (i) the current $i_{LS_1}$ or a parameter related to the current such as a current gain, (ii) the temperature, and (iii) the dim level. In at least one embodiment, the CCT and dim level controller 202 determines the light source current $i_{LS_2}$ through light source current $i_{LS_N}$ by accessing respective maps of values that represent the dependency between (i) the respective light source current and (ii) temperature, (iii) dim level or (iv) temperature and dim level.

In at least one embodiment, the CCT of light source 206.1 is more sensitive to the ambient temperature of the light engine 204 than the remaining light source(s) 206.2-206.N. Thus, in at least one embodiment, by making the light source current $i_{LS_1}$ jointly dependent on temperature and the dim level and the light source currents $i_{LS_2}$ through $i_{LS_N}$ dependent on the dim level, the CCT and dim level controller 202 can compensate for both temperature and dim level to generate a desired CCT of light engine 204. For example, in at least one embodiment, light engine 204 contains two light sources 206.1 and 206.2. In this example, light source 206.1 is a set of one or more red-amber LEDs, and light source 206.2 is a set of one or more blue-white LEDs. Relative to a brightness of the red-amber LEDs at a normal room temperature of +25° C., the brightness of red-amber LEDs can increase by as much as 200% as ambient temperatures decrease from +25° C. to −20° C., and the brightness can decrease to as low as 10% as ambient temperatures increase from +25° C. to +150° C. The brightness variation of blue-white LEDs is much more stable over variations in ambient temperature. Thus, since the blue-white LEDs vary only a relatively small amount with ambient temperature, the CCT and dim level controller 202 can control the CCT of the lamp 205 without adjusting the current $i_{LS_2}$ to the blue-white LEDs based on changes in the ambient temperature of the light engine 204. In another embodiment, the CCT and dim level controller 202 controls the CCT of the lamp 205 by adjusting both currents $i_{LS_1}$ and $i_{LS_2}$ based on both the dim level and the ambient temperature of light engine 204.

In at least one embodiment, the CCT and dim level controller 202 is part of a larger controller 210. The controller 210 generates P switching power converter control signals CS_SPC. "P" is an integer greater than or equal to 1. U.S. Patent Application Publication 2012/0025733 entitled "Dimming Multiple Lighting Devices by Alternating Energy Transfer From a Magnetic Storage Element", inventor John L. Melanson, assignee Cirrus Logic, Inc. (referred to herein as "Melanson I") describes exemplary methods and systems for generating the control signals CS_SPC to control a boost-type switching power converter with a fly-back converter. Melanson I is hereby incorporated by reference in its entirety. The implementation of controller 210 including CCT and dim level controller 202 is a matter of design choice. For example, controller 210 can be implemented as an integrated circuit, discrete components, or as a combination of an integrated circuit and discrete components. Additionally, in at least one embodiment, the controller 210 utilizes software to perform some functions.

Figure 3:
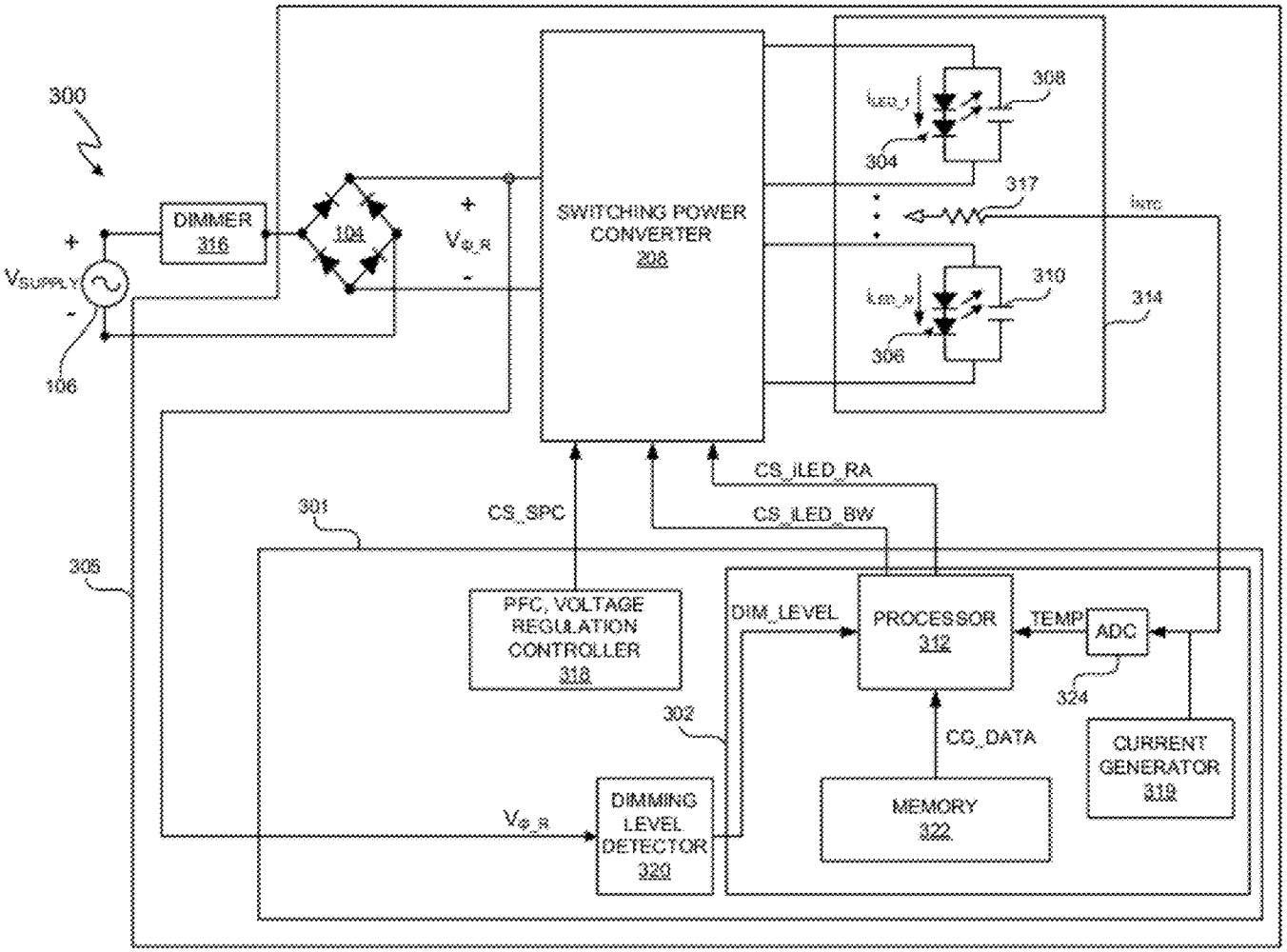
FIG. 3 depicts a lighting system 300, which represents one embodiment of the lighting system of FIG. 2.

FIG. 3 depicts lighting system 300, which represents one embodiment of lighting system 200. Controller 301 represents one embodiment of controller 210, and CCT and dim level controller 302 represents one embodiment of CCT and dim level controller 202. Lamp 305 represents one embodiment of lamp 205 (FIG. 2). The CCT and dim level controller 302 includes a processor 312 to generate the LED control signal CS_iLED_RA to control the LED current $i_{LED_RA}$ for the red-amber LEDs 304 and generates the LED control signal CS_iLED_BW to control the LED current $i_{LED_BW}$ for the blue-white LEDs 306. Capacitors 308 and 310 each provide a standard filter across respective LEDs 304 and LEDs 306. The LED current $i_{LED_RA}$ is jointly dependent on the ambient temperature of light engine 314 and the dim level as set by dimmer 316. In at least one embodiment, the CCT and dim level controller 302 determines the ambient temperature from the resistance value of the NTC resistor 317, which is in close proximity to LEDs 304 and LEDs 306 in light engine 314. The manner of determining the ambient temperature indicated by the NTC resistor 317 is a matter of design choice. In at least one embodiment, the CCT and dim level controller 302 determines the ambient temperature from a value of the current $i_{NTC}$. The resistance of NTC resistor 317 changes over time. In at least one embodiment, to correlate the value of the resistance of the NTC resistor 317 with a particular temperature, the current generator 319 generates a current $i_{NTC}$ so that the current $i_{NTC}$ generates a predetermined voltage, such as 2.5V, across the NTC resistor 317. An analog-to-digital converter (ADC) 324 converts the current $i_{NTC}$ into a digital ambient temperature data TEMP. In at least one embodiment, values of the ambient temperature data TEMP are stored as NTC codes, which correspond to particular temperatures. Table 1 represents exemplary NTC code values, and cells of Table 2 represent ambient temperatures in degrees Celsius for corresponding cells. For example, an NTC code of 13.7 in row 2, column 1 of Table 1 corresponds to 5.35° C. in row 2, column 1 of Table 2, NTC code 13.9 in row 2, column 2 of Table 1 corresponds to 5.70° C. in row 2, column 2 of Table 2, and so on.

TABLE 1

| TEMP (NTC CODES) | | | | | | | | | |
|---|---|---|---|---|---|---|---|---|---|
| 13.7 | 13.9 | 14.2 | 14.4 | 14.7 | 15.0 | 15.3 | 15.5 | 15.8 | 16.1 |
| 22.6 | 23.0 | 23.4 | 23.8 | 24.2 | 24.6 | 25.0 | 25.4 | 25.8 | 26.3 |
| 35.6 | 36.1 | 36.7 | 37.2 | 37.8 | 38.3 | 38.9 | 39.5 | 40.0 | 40.6 |
| 74.8 | 75.6 | 76.4 | 77.3 | 78.1 | 78.9 | 79.8 | 80.6 | 81.5 | 82.3 |
| 126.3 | 127.2 | 128.1 | 129.1 | 130.0 | 130.9 | 131.8 | 132.8 | 133.7 | 134.6 |
| 176.6 | 177.3 | 178.1 | 178.9 | 179.7 | 180.5 | 181.3 | 182.0 | 182.8 | 183.6 |

TABLE 2

| TEMPERATURE ° C. | | | | | | | | | |
|---|---|---|---|---|---|---|---|---|---|
| 5.35 | 5.70 | 6.05 | 6.40 | 6.75 | 7.10 | 7.45 | 7.80 | 8.15 | 8.50 |
| 15.35 | 15.70 | 16.05 | 16.40 | 16.75 | 17.10 | 17.45 | 17.80 | 18.15 | 18.50 |
| 25.35 | 25.70 | 26.05 | 26.40 | 26.75 | 27.10 | 27.45 | 27.80 | 28.15 | 28.50 |
| 45.35 | 45.70 | 46.05 | 46.40 | 46.75 | 47.10 | 47.45 | 47.80 | 48.15 | 48.50 |
| 65.35 | 65.70 | 66.05 | 66.40 | 66.75 | 67.10 | 67.45 | 67.80 | 68.15 | 68.50 |
| 85.35 | 85.70 | 86.05 | 86.40 | 86.75 | 87.10 | 87.45 | 87.80 | 88.15 | 88.50 |

In at least one embodiment, the ambient temperature data from the temperature data TEMP is also used by the PFC, voltage regulation controller 318 to provide over temperature protection for light engine 314 by, for example, reducing power delivered to light engine 314.

In at least one embodiment, the dimmer 316 is a phase-cut type dimmer, such as a triac-based dimmer. The dimmer 316 phase cuts the supply voltage $V_{SUPPLY}$ and, thus, the rectified supply voltage $V_{\phi_R}$. The dimming level detector 320 receives a sample of the rectified supply voltage $V_{\phi_R}$, determines the dim level of the rectified supply voltage $V_{\phi_R}$, and generates the dim signal DIM_LEVEL to represent the dim level. The dimming level detector 320 provides the dim signal DIM_LEVEL to processor 312 to control the LED current $i_{LED_RA}$. In at least one embodiment, the PFC, voltage regulation controller 318 also utilizes the dim signal DIM_LEVEL to control the switching power converter 208 as, for example, described in U.S. Pat. No. 7,667,408, entitled "Lighting System with Lighting Dimmer Output Mapping", inventors John L. Melanson and John Paulos, and assignee Cirrus Logic, Inc. ("Melanson II") describes exemplary embodiments of dimming level detector 320. Melanson II is hereby incorporated by reference in its entirety.

The processor 312 utilizes the temperature of the light engine 314 and the dim level of the lighting system 300 as represented by the respective TEMP and DIM_LEVEL signals, to generate the control signal CS_iLED_RA to control the current $i_{LED_RA}$. Thus, as subsequently described in more detail, the current $i_{LED_RA}$ follows a dim level and temperature dependent profile, which can be referenced as a surface. The processor 312 utilizes the dim level of the lamp 305, as represented by the data DIM_LEVEL, to generate the control signal CS_iLED_BW to control the current $i_{LED\ BW}$. Thus, as subsequently described in more detail, the current $i_{LED_BW}$ follows a dim level dependent profile, which can be referenced as curve. The particular shape of the surface and curve is a matter of design choice and generally depends on the desired dimming behavior, the type of LEDs 304 and 306, the configuration of lamp 305 including light engine 314, and power levels of lighting system 300.

The values of current $i_{LED_RA}$ for particular values of TEMP and DIM_LEVEL and the values of current $i_{LED_BW}$ for particular values of DIM_LEVEL can vary widely for different lamp designs. Accordingly, storing the values of the current $i_{LED_RA}$ and current $i_{LED_BW}$ for every combination of TEMP and DIM_LEVEL would require a large number of values and a wide dynamic memory range for the processor 312. Thus, in at least one embodiment, the processor 312 utilizes respective approximating functions to determine the values of the currents $i_{LED_RA}$ and $i_{LED_BW}$. In at least one embodiment, the currents $i_{LED_RA}$ and $i_{LED_BW}$ are normalized to respective reference values $i_{REF_RA}$ and $i_{REF_BW}$, the dim value DIM_LEVEL. Equation [1] represents an exemplary equation for determining the current $i_{LED_RA}$, and Equation [2] represents an exemplary equation for determining the current $i_{LED_BW}$:

$$i_{LED_{RA}}(T, D) = i_{REF_RA} \cdot D \cdot \left(\frac{i_{LED_{RA}}(T, D)}{i_{REF_RA} \cdot D}\right) = (i_{REF_RA} \cdot G_{RA}(T, D)) \cdot D \quad [1]$$

$$i_{LED_{BW}}(D) = i_{REF_BW} \cdot D \cdot \left(\frac{i_{LED_{BW}}(D)}{i_{REF_BW} \cdot D}\right) = (i_{REF_BW} \cdot G_{BW}(D)) \cdot D \quad [2]$$

where "T" is the TEMP value in Table 1 corresponding to the NTC code in Table 2, "D" is the dim level DIM_LEVEL, "$i_{REF_RA}$" is a reference current value for $i_{LED_RA}$, which in at least one embodiment is 378.708 mA, "$i_{REF_BW}$" is a reference current value for $i_{LED_BW}$, which in at least one embodiment is 502.596 mA "$G_{RA}$" is a red-amber LED current gain value, and "$G_{BW}$" is a blue-white LED current gain value. The particular value of the reference current values $i_{REF\ RA}$ and $i_{REF_BW}$ are matters of design choice. In at least one embodiment, the reference currents $i_{REF_RA}$ and $i_{REF_BW}$ are the actual, respective currents $i_{LED_RA}$ and $i_{LED_BW}$ used to obtain full intensity and desired CCT of respective LEDs 304 and LEDs 306 at a 25° C. ambient temperature and dim level of 100%. Other values of $i_{REF_RA}$ and $i_{REF_BW}$ can be used to keep the respective gain values $G_{RA}$ and $G_{BW}$ within a predetermined range for the determination of the respective values of currents $i_{LED\ RA}$ and $i_{LED\ BW}$. Thus, as indicated by Equation [1], the current $i_{LED\ RA}$ is jointly dependent on the temperature and dim level, and, as indicated by Equation [2], the current $i_{LED_BW}$ is dependent on the dim level.

As subsequently described in more detail, in at least one embodiment, Equation [1] is a surface that is approximated by a non-linear polynomial. The particular non-linear polynomial is a matter of design choice. Equation [3] represents an exemplary non-linear polynomial that approximates the first current gain $G_{RA}$ as a jointly dependent function of the ambient temperature NTC codes for TEMP and the dim levels of DIM_LEVEL.

$$G_{RA}=p00+p10\cdot T+p20\cdot T^2+p30\cdot T^3\cdot p01\cdot D+p02\cdot D^2+p03\cdot D^3+p11\cdot T\cdot D+p12\cdot T\cdot D^2+p21\cdot T^3\cdot D \quad [3].$$

"p_" represents coefficients for the Equation [3], which are a matter of design choice to approximate the gain $G_{RA}$. "T" represents the NTC code for the ambient temperature TEMP of light engine 314. "D" represents the dim level value of DIM_LEVEL. In at least one embodiment, once the first current gain $G_{RA}$ is determined in accordance with Equation [3], the processor 312 utilizes the values of the reference current $i_{REF_RA}$, the values of NTC code "T" and the dim level represented by D in Equation [1] to determine the current $i_{LED_RA}$ as a function of temperature and dim level. Table 3 contains exemplary values of the "p" coefficients for the red-amber LEDs 304:

TABLE 3

| p Coefficient | p Coefficient Values |
|---|---|
| p00 | 8.4791e−001 |
| p01 | 4.2052e−001 |
| p02 | −7.4559e−001 |
| p03 | 4.0798e−002 |
| p10 | −1.5790e+000 |
| p20 | 3.4750e+000 |
| p30 | −1.0969e+000 |
| p11 | 2.1946e+000 |
| p12 | −7.5712e−001 |
| p21 | −1.7105e+000 |
| p21 | −1.6032e+000 |

As subsequently described in more detail, in at least one embodiment, Equation [2] is a line-curve that is also approximated by a non-linear polynomial. The particular non-linear polynomial is a matter of design choice. Equation [4] represents an exemplary non-linear polynomial that approximates the second current gain $G_{BW}$ as a function of the dim levels of DIM_LEVEL.

$$G_{BW}=p0+p1\cdot D+p2\cdot D^2+p3\cdot D^3 \quad [4].$$

"p_" represents coefficients for the Equation [4], which are a matter of design choice to approximate the gain $G_{BW}$. "D" represents the dim level value of DIM_LEVEL. In at least one embodiment, once the second current gain $G_{BW}$ is determined in accordance with Equation [4], the processor 312 utilizes the values of the reference current $i_{REF_BW}$ and the dim level represented by d in Equation [2] to determine the current $i_{LED_BW}$ as a function of temperature and dim level. In at least one embodiment, the "p" coefficients of Equations [3] and [4] are stored in non-volatile memory 322. In at least one embodiment, the coefficients are programmable, and the values are stored to achieve a desired CCT and intensity response of the light engine 314 to various dim levels and ambient temperature variations. Table 4 contains exemplary values of the "p" coefficients for the blue-white LEDs 306:

TABLE 4

| p Coefficients | p Coefficient Values |
|---|---|
| p0 | 8.9746e−001 |
| p1 | 1.1252e+000 |
| p2 | −4.9033e−001 |
| P3 | −5.4427e−001 |

In another embodiment, Equations [1] and [2] include respective gain calibration factors $GAIN_CAL_{RA}$ and $GAIN_CAL_{BW}$ to calibrate the respective values of $i_{LED_RA}$ and $i_{LED_BW}$ pursuant to manufacturing calibration tests. For example, the CCT's of LEDs at a particular LED current value do not all match. The calibration factors allow the CCT and dim level controller 302 to match the CCT of each LED in LEDs 304 and LEDs 306 to obtain a known CCT of each set LEDs 304 and LEDs 306 and, thus, a known CCT of lamp 305. In at least one embodiment, the respective gain calibration factors $GAIN_CAL_{RA}$ and $GAIN_CAL_{BW}$ are stored in the memory 322 after the lamps 314 are built. Equations [5] and [6] represent exemplary modifications of Equations [1] and [2] to include the respective gain calibration factors $GAIN_CAL_{RA}$ and $GAIN_CAL_{BW}$:

$$i_{LED_{RA}}(T,D)=(i_{REF_RA}\cdot G_{RA}(T,D))\cdot D\cdot GAIN_CAL_{RA} \quad [5]$$

$$i_{LED_{BW}}(D)=(i_{REF_BW}\cdot G_{BW}(D))\cdot D\cdot GAIN_CAL_{BW} \quad [6]$$

In at least one embodiment, the processor 302 utilizes Equations [1] and [2], Equations [5] and [6], or approximations thereof, such as Equations [3] and [4] to determine the currents $i_{LED_RA}$ and $i_{LED_BW}$ in real-time using sampled values of the temperature and dim level. In other embodiments, values of current $i_{LED_RA}$ and/or $i_{LED_BW}$ are precomputed for various values of the temperature, dim level, and/or gain calibration and stored in a look-up-table. In at least one embodiment, the processor 302 generates the control signals CS_iLED_RA and/or CS_iLED_BW from values of currents $i_{LED_RA}$ and $i_{LED_BW}$ in the look-up-table (such as the subsequently described tables in FIGS. 9 and 11).

Figure 4:
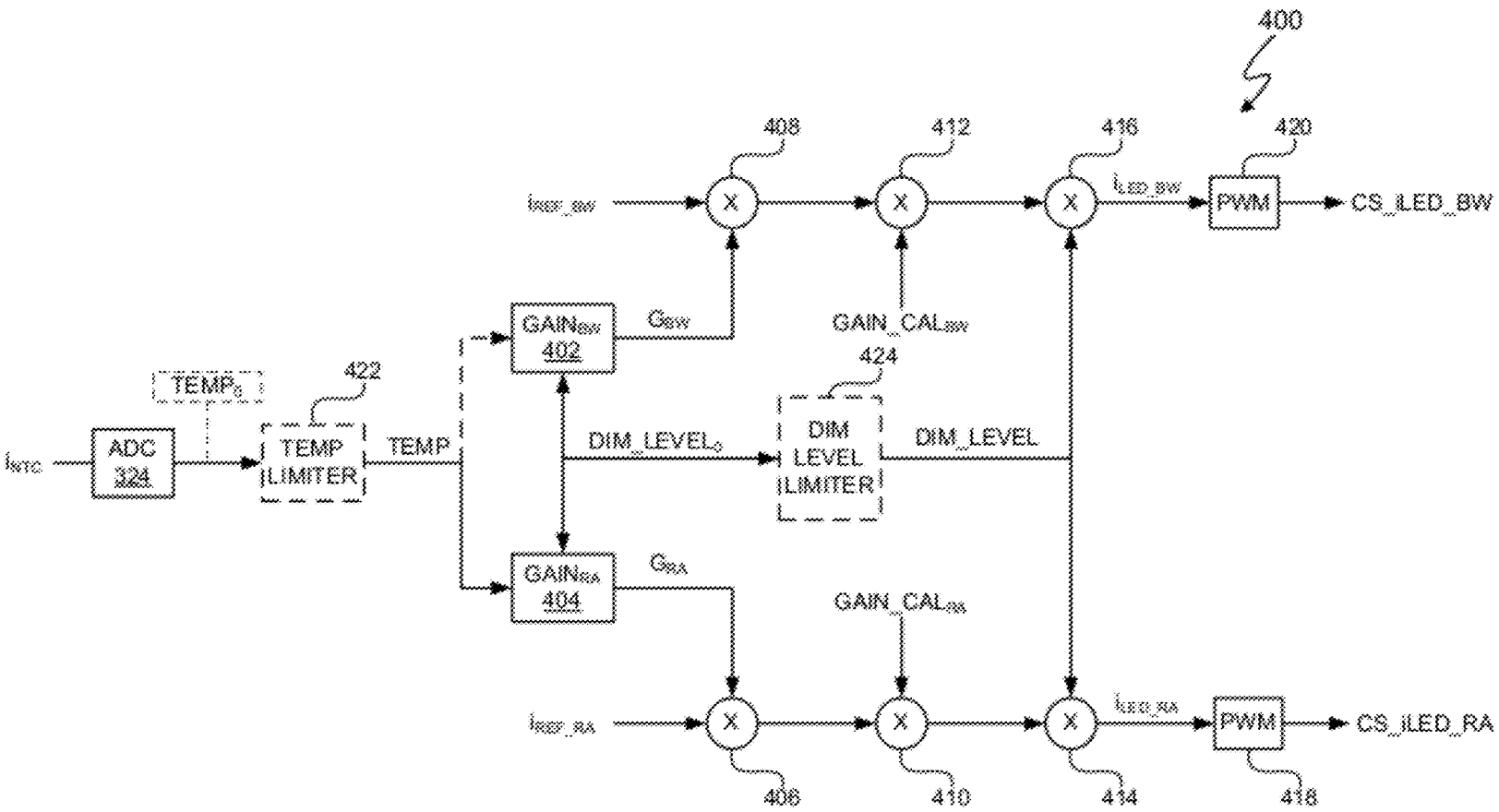
FIG. 4 depicts a processor, which represents one embodiment of a processor of a CCT and dim level controller of the lighting system of FIG. 3.

FIG. 4 depicts processor 400, which represents an exemplary processor 312. ADC 324 converts the current across NTC resistor 317 for a constant voltage into the ambient temperature data TEMP. The data TEMP and $DIM_LEVEL_0$ is used by GAIN_RA module 404 to calculate current gain factor $G_{RA}$ in accordance with Equation [3]. The value of $DIM_LEVEL_0$ represents the decoded dim level. The GAIN_BW module 402 uses the $DIM_LEVEL_0$ to calculate the current gain factor $G_{BW}$ in accordance with Equations [4]. In at least one embodiment, the GAIN_BW module 402 utilizes a modified Equation [4] to calculate the current gain factor $G_{BW}$ as jointly dependent upon dim level and temperature. The particular modification of Equation [4] is a matter of design choice and depends on the desired CCT and dim level response of the LEDs 306 (FIG. 3).

Multipliers 406 and 408 multiply the respective gain factors $G_{RA}$ and $G_{BW}$ with the respective reference current values of $i_{REF_RA}$ and $i_{REF_BW}$. Processor 400 implements Equations [5] and [6]. So, multiplier 410 multiplies $G_{RA}\cdot i_{REF_RA}$ by the gain calibration factor $GAIN_CAL_{RA}$, and multiplier 412 multiplies $G_{BW}\cdot i_{REF_BW}$ by the gain calibration factor $GAIN_CAL_{BW}$. Multiplier 414 multiplies $G_{RA}\cdot i_{REF_RA}\cdot GAIN_CAL_{RA}$ by the dim level DIM_LEVEL to determine the value of current $i_{LED_RA}$. Multiplier 416 multiplies $G_{BW}\cdot i_{REF_BW}\cdot GAIN_CAL_{BW}$ by the dim level DIM_LEVEL to determine the value of current $i_{LED_BW}$. Pulse width modulators PWM 418 and PWM 420 convert the respective values of current $i_{LED_RA}$ and $i_{LED_BW}$ into respective control signals CS_iLED_RA and CS_iLED_BW as, for example, described in Melanson I. In at least one embodiment, the switching power converter is configured as described in Melanson I to utilize the control signals CS_iLED_RA and CS_iLED_BW to generate the respective currents $i_{LED_RA}$ and $i_{LED_BW}$.

In an optional embodiment, processor 400 includes temp limiter 422 and/or dim limiter 424 (shown in dashed lines). If the ambient temperature is too high or too low, in at least one embodiment, the gain approximations determined by Equations [3] and [5] can have an error that is too large. In other words, near the boundaries of Equations [3] and [5], the difference between the gain generated by Equations [3] and [5] and the actual relationship between the gain and the dim level and temperature (Equation [3]) values can be unacceptably large and result in unacceptable gain error and, thus, unacceptable LED current-to-(dim level and temperature) values. The temp limiter 422 sets boundary conditions to prevent the gain error from becoming too large as a result in errors in the approximations of the gain errors at the temperature boundaries. For example, in at least one embodiment, the temp limiter 422 receives the $TEMP_0$ value from ADC 324 and limits the output data TEMP of the temp limiter 422 to a value between a low temperature saturation value and a high temperature saturation value. In at least one embodiment, the low temperature saturation value is between −5° C. and +15° C., such as +10° C. In at least one embodiment, the high temperature saturation value is between 100° C. and 130° C., such as 120° C.

Similarly, the dim level limiter 424 receives the $DIM_LEVEL_0$ value as the decoded dim level, and the dim level limiter 424 sets boundary conditions to prevent the gain error from becoming too large as a result of errors in the approximations of the gain errors at the dim level boundaries. For example, in at least one embodiment, the dim level limiter 424 receives the $DIM_LEVEL_0$ value and limits the output data DIM_LEVEL of the dim level limiter 422 to a value between a low dim level saturation value and a high dim level saturation value. In at least one embodiment, the low dim level saturation value is between 1% and 10%, such as 2%. In at least one embodiment, the high dim level saturation value is between 90% and 100%. The quantitative values associated with values that are referenced with regard to gain errors that are "unacceptable" and "too large" are matters of design choice.

Figure 5:
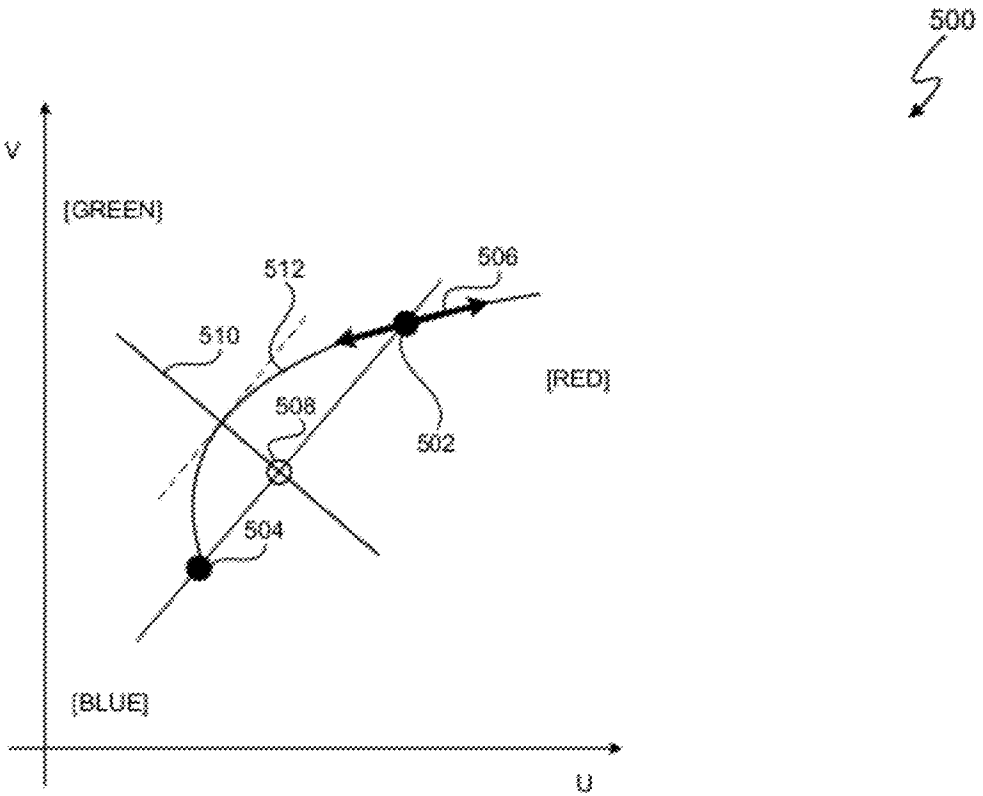
FIG. 5 depicts an exemplary chromaticity diagram for a lamp in the lighting system of FIG. 3.

FIG. 5 depicts an exemplary chromaticity diagram 500 for lamp 305 (FIG. 3) using UV coordinates according to the International Commission on Illumination (CIE) 1960 UCS (uniform chromaticity scale). The chromaticity diagram 500 represents an exemplary interaction between the CCT of LEDs 304 and LEDs 306. In at least one embodiment, the exemplary interaction can be used as a model to design the coefficients of Equations [3] and [4] to obtain a desired CCT response of the LEDs 304 of light engine 314 of lamp 305 to variations in temperature and dim level. Actual color coordinates can be empirically determined using actual LEDs. The closed circle 502 represents the chromaticity of the red-amber LEDs 304, and the closed circle 504 represents the chromaticity of the blue-white LEDs 306. The chromaticity of LEDs 304 is jointly dependent on temperature as indicated by arrow 506.

Changes in the dim level do not appreciably change the color coordinate of a particular LED. Changes in the dim level primarily affect the magnitude of the spectrum of a particular LED. However, changes in the dim level and ambient temperature can appreciably change the spectrum resulting from the mixing of light from LEDs 304 and relocate a coordinate of the open circle 508 which lies along the line joining the coordinates of the closed circles 502 and 504 of the two individual LED groups.

The open circle 508 lies on the intersection of the line between closed circles 502 and 504 and the isotherm line 510. In a UVW coordinate system, the isotherm line 510 is perpendicular to the tangent of the Planckian locus 512. The open circle 508 represents the chromaticity of the lamp 305. Any point on the isotherm line 510 is said to have a CCT equal to the temperature of a black body and chromaticity equal to the u-v coordinates of the point of intersection of curve 512 and isotherm 510.

Figure 6:
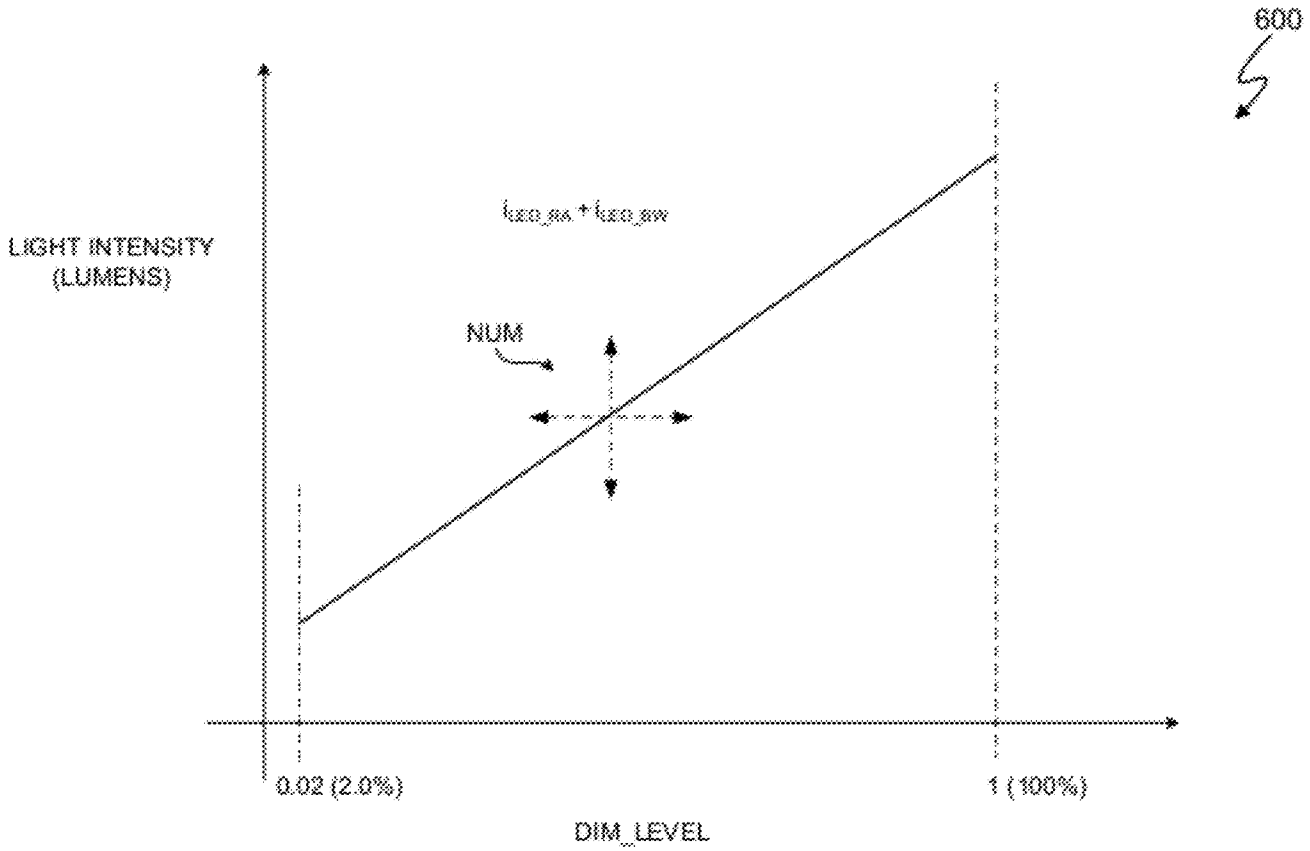
FIG. 6 depicts a light intensity-dim level graph.

FIG. 6 depicts an exemplary light intensity-dim level graph 600 that depicts an exemplary relationship between the currents $i_{LED_RA}$ and $i_{LED_BW}$ for values of dim level DIM_LEVEL and the light intensity of the LEDs 304 and 306 of light engine 314. The intensity of light engine 314 is a function of the sum of the currents $i_{LED_RA}$ and $i_{LED_BW}$ and the dim level DIM_LEVEL. The dashed arrows 602 indicate that the particular relationship between the sum of the currents, the light intensity, and the dim level DIM_LEVEL is a matter of design choice and can, for example, have a different slope than indicated in FIG. 6 and can be a linear function as shown in FIG. 6 or a non-linear function. Thus, in at least one embodiment, Equations [3] and [4] are designed so that the sum of the currents $i_{LED_RA}$ and $i_{LED_BW}$ produce the desired relationship between dim level DIM_LEVEL and the desired intensity of light engine 314. The particular relationship is a matter of design choice. However, by utilizing lighting system 300, the light engine 314 can produce human perceivable intensity changes for a wide range of dimming levels, for example from 1 (100%—full brightness) to 0.2 (2.0% of full brightness).

Figure 7:
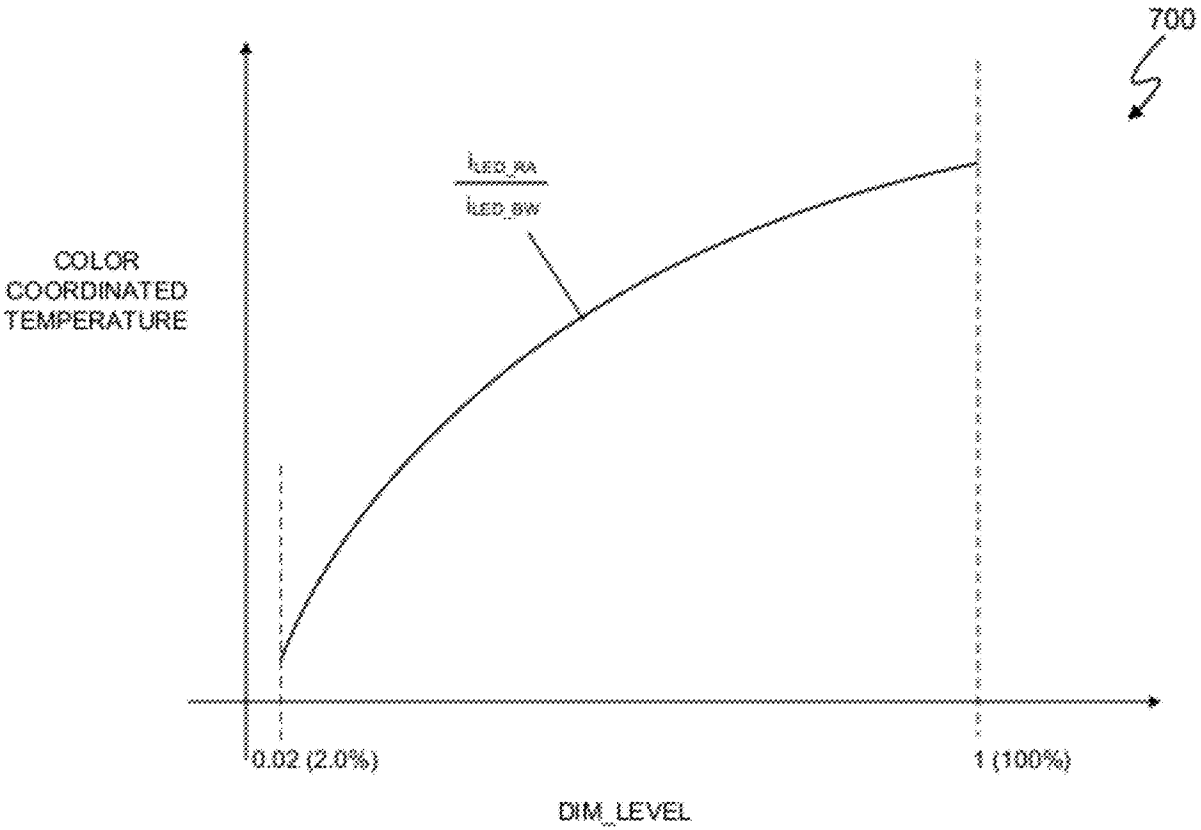
FIG. 7 depicts a CCT-dim level graph.

FIG. 7 depicts an exemplary CCT-dim level graph 700 that depicts an exemplary relationship between the currents $i_{LED_RA}$ and $i_{LED_BW}$ for values of dim level DIM_LEVEL and the CCT of light engine 314. The CCT of light engine 314 is related to the ratio of the currents $i_{LED_RA}$ and $i_{LED_BW}$. Thus, in at least one embodiment, Equations [3] and [4] are designed so that the ratio of the currents $i_{LED_RA}$ and $i_{LED_BW}$ produce the desired relationship between dim level DIM_LEVEL and the CCT of light engine 314. The particular relationship is a matter of design choice. However, by utilizing lighting system 300, the light engine 314 can produce human perceivable CCT changes for a wide range of dimming levels, for example from 1 (100%—full brightness) to 0.02 (2.0% of full brightness).

Figure 8:
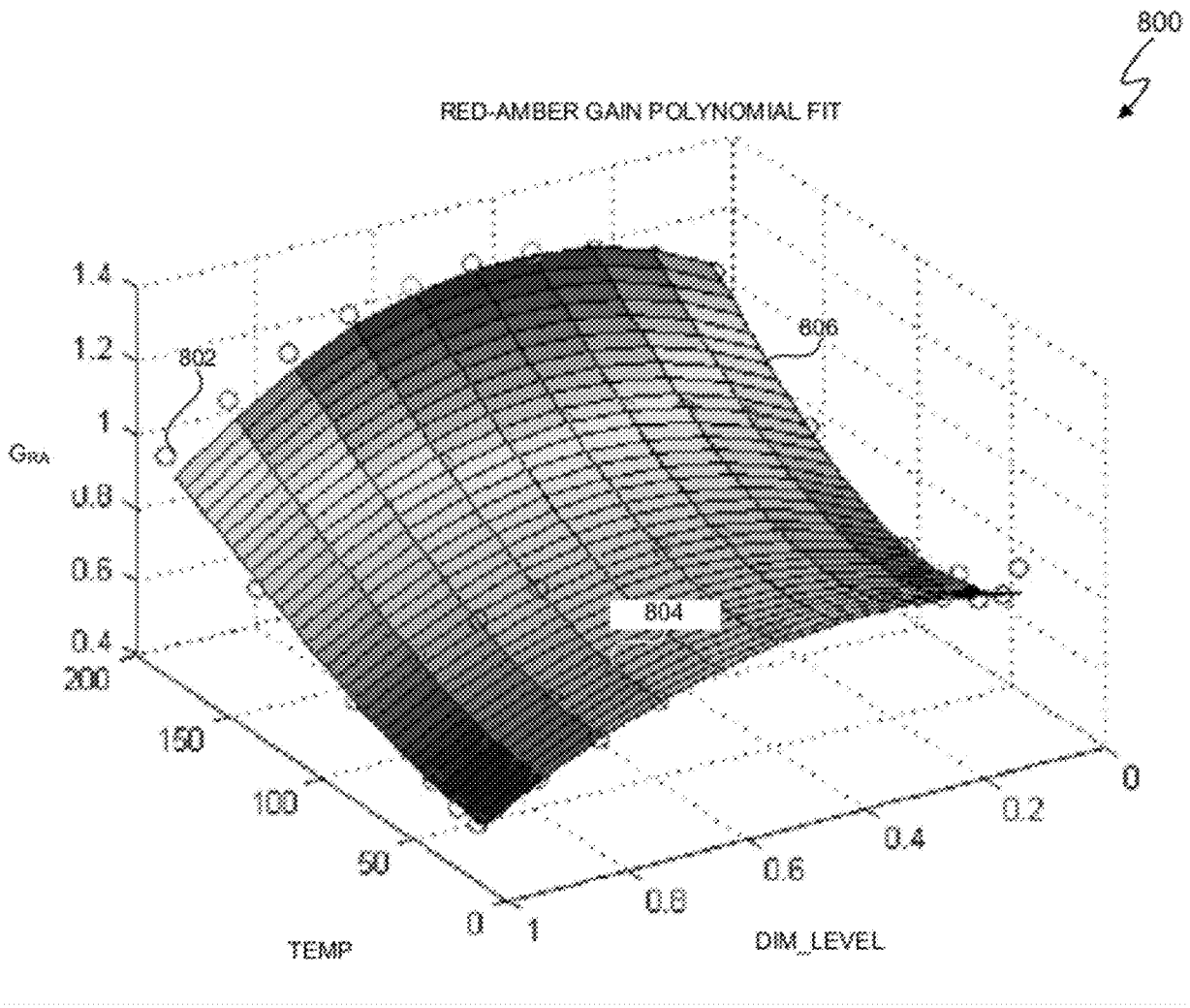
FIG. 8 depicts a red-amber LEDs polynomial fit current gain surface.

FIG. 8 depicts an exemplary red-amber LEDs 304 polynomial fit $G_{RA}$ surface 800. Referring to FIGS. 3 and 8, the polynomial fit surface 800 represents an exemplary jointly dependent relationship between the gain $G_{RA}$, the ambient temperature of light engine 314, and the dim level of lighting system 300. The open circles, such as open circles 802 and 804 represent actual gain data, and the surface 806 represents a non-linear approximation of the polynomial fit by Equation [3] relative to the actual gain data depicted by the open circles, such as open circles 802 and 804. The approximation by Equation [3] is sufficient to accurately determine the gain $G_{RA}$ for Equations [1] and [5] so that the determined current $i_{LED_RA}$ generates a CCT of LEDs 304 in close approximation to the actual desired CCT as illustrated by the open circles, such as the open circles 802 and 804. The particular design of the surface 806 and, thus, the design of Equation [3] is a matter of design choice. In at least one embodiment, Equation [3] and the coefficients thereof are programmable to obtain the desired CCT of LEDs 304 in response to the data TEMP and the dim level DIM_LEVEL.

FIG. 9 depicts exemplary values of the current $i_{LED_RA}$ used to obtain a particular response of the red-amber LEDs 304 for the desired CCT versus dim level and intensity versus dim level at different ambient temperatures. The exemplary values of the current $i_{LED_RA}$ are jointly dependent on the ambient temperature data TEMP and the dim level DIM_LEVEL. In at least one embodiment, the values are stored in memory 322 as a look-up-table to determine the values in FIG. 9 of current $i_{LED_RA}$ for particular dim levels and ambient temperatures. The processor 312 can, in at least one embodiment, interpolate the values of the current $i_{LED_RA}$ for temperatures and dim levels not in FIG. 9 using any desired linear or non-linear interpolation function. In at least one embodiment, the table of FIG. 9 can be expanded to accommodate any number of values for temperature, dim level, and/or current $i_{LED_RA}$.

Figure 10:
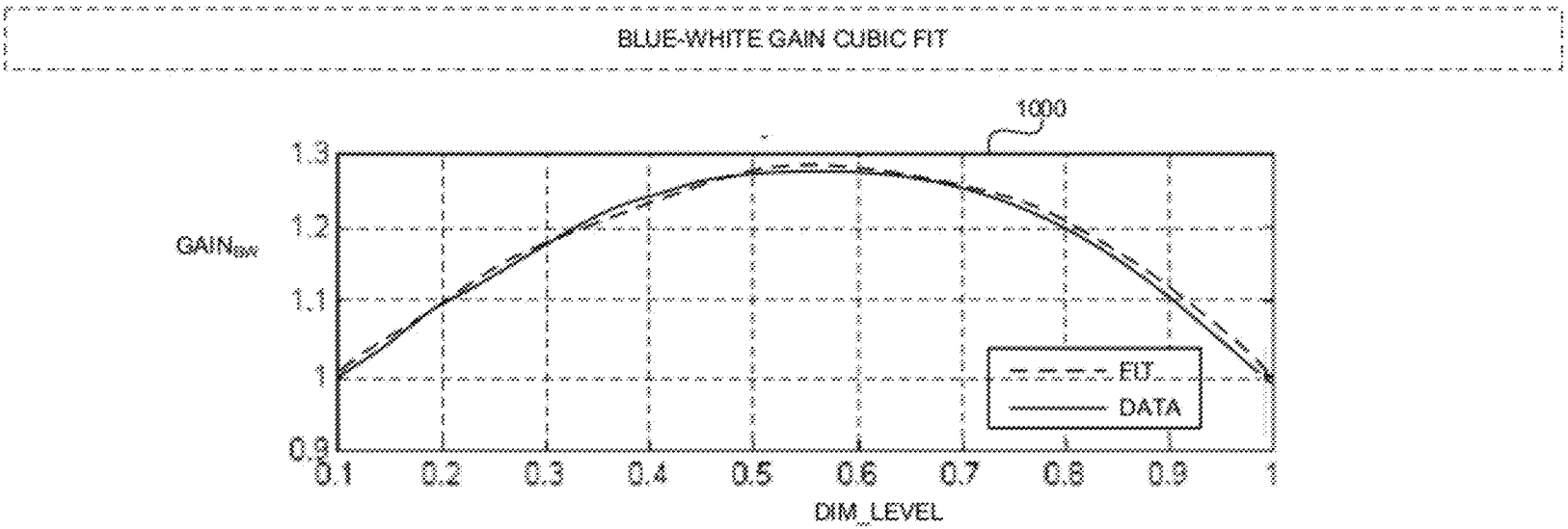
FIG. 10 depicts a blue-white LEDs polynomial fit line curve.

FIG. 10 depicts an exemplary blue-white LEDs 306 polynomial fit gain $G_{BW}$ line curve 900. Referring to FIGS. 3 and 10, the polynomial fit, non-linear curve 1000 represents an exemplary fit between the gain $G_{BW}$ and the dim level of lighting system 300 as determined by Equation [4]. The approximation by Equation [4] is sufficient to accurately determine the gain $G_{BW}$ for Equations [2] and [6] so that the determined current $i_{LED_BW}$ generates a response of LEDs 306 in close approximation to the actual desired response as illustrated by the line curve 1000. The particular design of the line curve 1000 and, thus, the design of Equation [4] is a matter of design choice. In at least one embodiment, Equation [4] and the coefficients thereof are programmable to obtain the desired CCT of LEDs 306 in response to the dim level DIM_LEVEL.

FIG. 11 depicts exemplary values of $i_{LED_BW}$ for a nominal junction temperature of 93° C. as determined using Equations [2] and [4], which are dependent on the dim level DIM_LEVEL. Since the junction temperature of the LEDs 306 is relatively unaffected by the ambient temperature of light engine 314, the values at the nominal junction temperature provide, in at least one embodiment, acceptable approximations for a full range of ambient operating temperatures of light engine 314. In at least one embodiment, the values in the table of FIG. 11 are stored in memory 322 as a look-up-table to determine the values of current $i_{LED_BW}$ for particular dim levels. The processor 312 can, in at least one embodiment, interpolate the values of the current $i_{LED_BW}$ for dim levels not in FIG. 9 using any desired linear or non-linear interpolation function. In at least one embodiment, the table of FIG. 11 can be expanded to accommodate any number of values for dim level and current $i_{LED_BW}$. Additionally, in at least one embodiment, temperature values can also be added to FIG. 11 as with FIG. 9.

Thus, a lighting system controls the color spectrum of a lamp in response to both temperature and dim levels. In at least one embodiment, the lighting system includes a controller to control a CCT and intensity of the lamp by independently adjusting currents to electronic light sources based on a dim level of the lighting system and temperature of the lighting system. In at least one embodiment, the controller is capable of controlling a first current to a first set of one or more electronic light sources and controlling a second current to a second set of one or more electronic light sources. The control of the first current by the controller is jointly dependent on a dim level and temperature in the lighting system. In at least one embodiment, the control of the second current is dependent on the dim level or the dim level and temperature.

Although embodiments have been described in detail, it should be understood that various changes, substitutions, and alterations can be made hereto without departing from the spirit and scope of the invention as defined by the appended claims.

What is claimed is:

1. A lighting system comprising:

a controller capable of controlling a first current to a first set of one or more electronic light sources and controlling a second current to a second set of one or more electronic light sources, wherein:

control of the first current by the controller is jointly dependent on a dim level and a temperature in the lighting system;

control of the second current by the controller is dependent on the dim level in the lighting system and control of the second current by the controller includes determining a value of the second current in accordance with a first function that does not adjust the second current in accordance with the temperature of the lighting system;

the first set of one or more electronic light sources has a first correlated color temperature (CCT); and the second set of one or more electronic light sources has a second CCT.

2. The lighting system of claim 1 wherein the controller is capable of controlling the first current to control the first CCT and brightness by determining a value of the first current in accordance with a second function that represents a joint dependency of the first current and at least the temperature and the dim level.

3. The lighting system of claim 1 wherein the controller comprises:

a digital signal processor; and a memory coupled to the digital signal processor, wherein the memory stores coefficients of the first and second functions, and, during operation, the digital signal processor utilizes the first and second functions and coefficients to determine a first control signal to control the first current and a second control signal to control the second current.

4. The lighting system of claim 3 wherein the lighting system comprises a lamp that houses at least the controller and the first and second sets of the electronic light sources and the lamp is configured to receive at least a portion of the coefficients during calibration of the lamp after the lamp is fully assembled.

5. The lighting system of claim 2 wherein the second function represents a map of a three dimensional, jointly dependent relationship between the temperature, the dim level, and a parameter related to at least the first current.

6. The lighting system of claim 5 wherein the first function represents a map of a line curve representing a relationship between the dim level and a parameter related to at least the first current.

7. The lighting system of claim 5 wherein the map represents a nonlinear relationship between the temperature, the dim level, and a parameter related to at least the first current.

8. The lighting system of claim 7 wherein the nonlinear relationship is defined using polynomial approximations.

9. The lighting system of claim 5 wherein the parameter related to at least the first current is a gain of the first current.

10. The lighting system of claim 2 wherein the first and second set of electronic light sources are contained within a lamp, and the controller is capable of adjusting the first current and the second current to maintain an approximately constant CCT of the lamp as the temperature changes.

11. The lighting system of claim 1 wherein the controller is capable of controlling the first current independently of the second current.

12. The lighting system of claim 1 wherein the controller is capable of controlling the first and second currents to coordinate changes in the first and second color spectrum in response to changes in the dim level.

13. The lighting system of claim 1 wherein the controller is capable of utilizing at least jointly dependent temperature and dim level variables of the lighting system to control the first current to the first set of the one or more electronic light sources.

14. The lighting system of claim 1 wherein the first set of one or more electronic light sources comprises one or more light emitting diodes and the second set of one or more electronic light sources comprises one or more light emitting diodes.

15. The lighting system of claim 1 wherein the temperature represents an ambient temperature within a housing that houses the first and second sets of electronic light sources.

16. The lighting system of claim 1 wherein the dim level is a dim level for the lighting system.

17. The lighting system of claim 16 wherein the dim level is a function of a phase angle of a phase modulated supply voltage to the lighting system.

18. The lighting system of claim 1 wherein the controller is further capable of generating a control signal to control a power converter.

19. The lighting system of claim 18 wherein the power converter is a member of a group consisting of: a boost switching power converter, a buck switching power converter, a flyback switching power converter, a boost-buck switching power converter, and a Cúk switching power converter.

20. The lighting system of claim 1 wherein the controller is capable of utilizing the at least jointly dependent temperature and dim level variables of the lighting system to control N sets of one or more electronic light sources, wherein N is an integer greater than or equal to 2.

21. A method comprising:

controlling a first current to a first set of one or more electronic light sources and controlling a second current to a second set of one or more electronic light sources in a lighting system, wherein:

control of the first current by the controller is jointly dependent on a dim level and a temperature in the lighting system;

control of the second current by the controller is dependent on the dim level in the lighting system and control of the second current by the controller includes determining a value of the second current in accordance with a first function that does not adjust the second current in accordance with the temperature of the lighting system;

the first set of one or more electronic light sources has a first correlated color temperature (CCT); and the second set of one or more electronic light sources has a second CCT.

22. The method of claim 21 further comprising:

controlling the first current to control the first CCT and brightness by determining a value of the first current in accordance with a second function that represents a joint dependency of the first current and at least the temperature and the dim level.

23. The method of claim 22 further comprising:

storing coefficients of the first and second functions in a memory of a controller configured to control a switching power converter; and utilizing the first and second functions and coefficients to determine a first control signal to control the first current and a second control signal to control the second current.

24. The method of claim 23 further comprising:

receiving at least a portion of the coefficients in a lamp during calibration of the lamp after the lamp is fully assembled.

25. The method of claim 22 wherein the second function represents a map of a three dimensional, jointly dependent relationship between the temperature, the dim level, and a parameter related to at least the first current.

26. The method of claim 25 wherein the first function represents a map of a line curve representing a relationship between the dim level and a parameter related to at least the first current.

27. The method of claim 25 wherein the map represents a nonlinear relationship between the temperature, the dim level, and a parameter related to at least the first current.

28. The method of claim 27 wherein the nonlinear relationship is defined using polynomial approximations.

29. The method of claim 25 wherein the parameter related to at least the first current is a gain of the first current.

30. The method of claim 2 wherein the first and second set of electronic light sources are contained within a lamp and the method further comprises:

adjusting the first current and the second current to maintain an approximately constant CCT of the lamp as the temperature changes.

31. The method of claim 21 further comprising:

controlling the first current independently of the second current.

32. The method of claim 21 further comprising:

controlling the first and second currents to coordinate changes in the first and second color spectrum in response to changes in the dim level.

33. The method of claim 21 further comprising:

utilizing at least jointly dependent temperature and dim level variables of the lighting system to control the first current to the first set of the one or more electronic light sources.

34. The method of claim 21 wherein the first set of one or more electronic light sources comprises one or more light emitting diodes and the second set of one or more electronic light sources comprises one or more light emitting diodes.

35. The method of claim 21 wherein the temperature represents an ambient temperature within a housing that houses the first and second sets of electronic light sources.

36. The method of claim 21 wherein the dim level is a dim level for the lighting system.

37. The method of claim 36 wherein the dim level is a function of a phase angle of a phase modulated supply voltage to the lighting system.

38. The method of claim 21 further comprising:

generating a control signal to control a power converter.

39. The method of claim 38 wherein the power converter is a member of a group consisting of: a boost switching power converter, a buck switching power converter, a flyback switching power converter, a boost-buck switching power converter, and a Cúk switching power converter.

40. The method of claim 21 further comprising:

utilizing the at least jointly dependent temperature and dim level variables of the lighting system to control N sets of one or more electronic light sources, wherein N is an integer greater than or equal to 2.

41. An apparatus comprising:

means for controlling a first current to a first set of one or more electronic light sources and controlling a second current to a second set of one or more electronic light sources in a lighting system, wherein:

control of the first current by the controller is jointly dependent on a dim level and a temperature in the lighting system;

control of the second current by the controller is dependent on the dim level in the lighting system and control of the second current by the controller includes determining a value of the second current in accordance with a first function that does not adjust the second current in accordance with the temperature of the lighting system;

the first set of one or more electronic light sources has a first correlated color temperature (CCT); and the second set of one or more electronic light sources has a second CCT.

* * * * *